United States Patent [19]

McCauley

[11] 4,346,692

[45] Aug. 31, 1982

[54] MAKE-UP AIR DEVICE FOR RANGE HOOD

[76] Inventor: Lewis C. McCauley, Box 895, Murfreesboro, Tenn. 37130

[21] Appl. No.: 210,270

[22] Filed: Nov. 26, 1980

[51] Int. Cl.[3] ..... F21C 15/08; F24J 11/00

[52] U.S. Cl. ..... 126/299 D; 55/DIG. 36

[58] Field of Search ..... 126/299 R, 299 D, 299 E; 98/36, 110, 115 R, 114, 108; 55/DIG. 36

[56] References Cited

U.S. PATENT DOCUMENTS

| | | | |
|---|---|---|---|
| 4,146,017 | 3/1979 | Overton, Jr. | 126/299 D |
| 4,155,348 | 5/1979 | Ahlrich | 126/299 D |
| 4,286,572 | 9/1981 | Searcy et al. | 126/299 D |

*Primary Examiner*—James C. Yeung

*Attorney, Agent, or Firm*—Harrington A. Lackey

[57] ABSTRACT

A make-up air device for an overhead exhaust hood for a cooking range including a supply air plenum having a controlled air chamber in the outlet passage of the plenum for controlling the volume, velocity and direction of the flow of make-up air from the plenum over the cooking range. The controlled air chamber includes an upper inlet portion projecting into the air plenum space and including variably controlled damper blades. The lower discharge end of the control chamber includes adjustable louvers for controlling the direction of the discharged air. The adjustable louvers may be mounted in the bottom wall of the control chamber or the side wall. When the adjustable louvers are in the bottom wall, the side wall may be perforated to provide a by-pass flow. Moreover, when the adjustable louvers are in the bottom wall, a transverse perforated plate may be installed in the chamber between the inlet dampers and the discharge louvers in order to dampen the velocity of the air flow.

7 Claims, 11 Drawing Figures

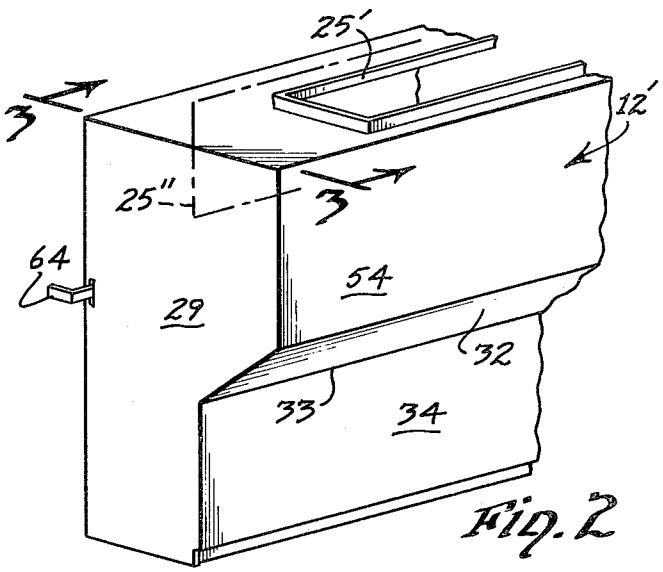
Fig. 2
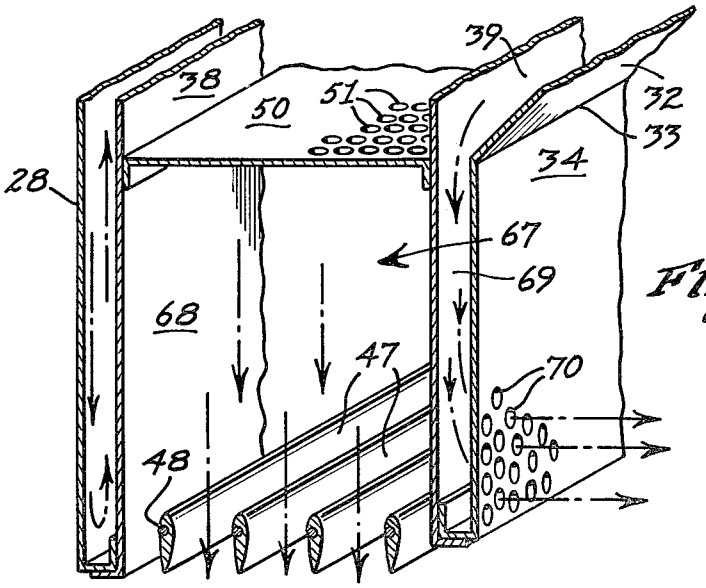
Fig. 8
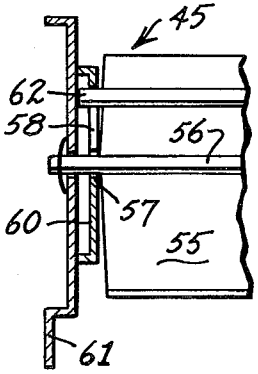
Fig. 7
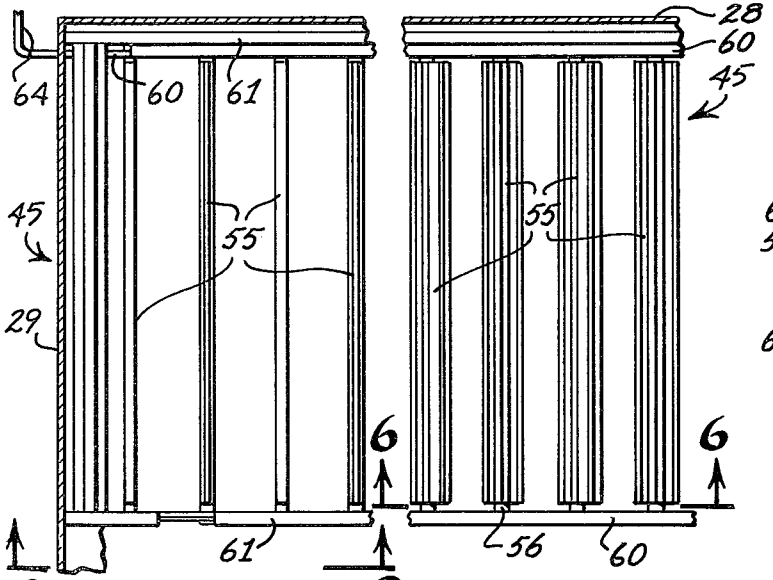
Fig. 4A
Fig. 4
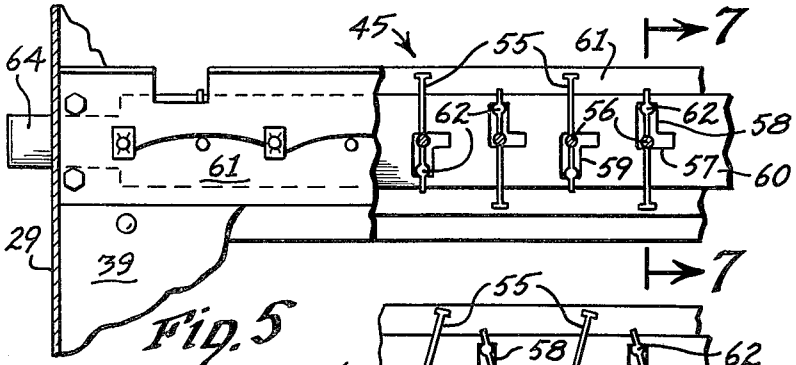
Fig. 5
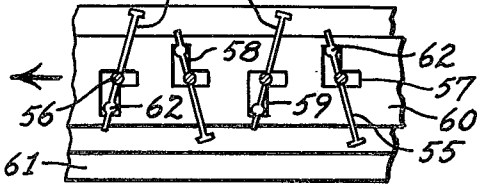
Fig. 6

MAKE-UP AIR DEVICE FOR RANGE HOOD

BACKGROUND OF THE INVENTION

This invention relates to range hoods, and more particularly to a make-up air device for a range hood.

A typical exhaust hood for a cooking range includes an exhaust plenum mounted over the range and an exhaust fan for drawing air containing grease, vapor, smoke, and other particulates upward away from the range and out of the cooking area. Of course, when the foul air is withdrawn from the cooking area, it must be replaced by make-up air from another source. Generally, in commercial kitchens, such as in restaurants and institutions, the make-up air is quite frequently brought into the cooking area from the outdoors, sometimes through a supply air plenum including a single register having restricted openings. A make-up or supply fan may force air into the supply air plenum, and/or the air may be drawn across the range by the suction from the exhaust fan.

However, in spite of the efforts to restrict the supply air flow adjacent the cooking range, because of the minimal control of the direction of the supply air, inevitably a substantial amount of make-up air is drawn from the space within the cooking area or kitchen, thereby disturbing the equilibrium of the conditioned air within the cooking air. In the winter time, the kitchen area will tend to be cooled by the withdrawal of the normally heated air through the exhaust hood, and in the summer, the cool conditioned air within the kitchen will also be drawn through the exhaust hood, creating an extra energy demand upon the heating and cooling equipment for the kitchen area.

Moreover, in prior make-up air systems, the supply air, because of its high velocity and lack of direction, frequently creates a draft upon the cooks to their discomfort and sometimes ill-health.

The supply air registers conventionally used have a restricted air flow because of their small free area. Thus, the velocity of the air has to be increased in order to adequately ventilate the area over the cooking range, and consequently produces the undesirable drafts.

Some make-up air systems include perforated plates above the air discharge slot from the supply air plenum, but have no volume or velocity control.

Discharge louvers have been utilized as optional features in the discharge slot of some make-up systems for a range hood in order to control the direction of the air, but have not been utilized in combination with means for controlling the volume of air as well.

Even in prior art make-up air systems which employ registers, perforated plates, or discharge louvers, narrow jets of high velocity air still flow through at least some of the discharge openings because of the increase in fluid velocities generated by the sudden expansion of air flowing from the supply duct into the plenum from which the air is discharged.

SUMMARY OF THE INVENTION

It is therefore an object of this invention to provide a make-up air system for use in combination with the exhaust hood over a cooking range in order to adequately control the volume, velocity and direction of the make-up air to minimize the loss of conditioned air within the cooking or kitchen area, and to minimize, if not eliminate, undesirable drafts upon the cooks and other kitchen personnel.

In order to accomplish the above objectives and to overcome the disadvantages of the prior art make-up air systems in range hoods, the make-up air device made in accordance with this invention includes a supply air plenum having a supply air inlet for communicating with air from outside the cooking air.

The supply air plenum includes in its lower portion a forward declining rear wall, terminating in an outlet passage in the bottom of the supply air plenum. Mounted in this outlet passage is a vertically disposed controlled air chamber having an upper portion projecting above the outlet passage and terminating in an upper inlet portion in which is mounted a variably controlled damper mechanism for accurately controlling the volume of air introduced into the controlled air chamber from the supply plenum. The upper portion of the controlled air chamber has an upright rear wall which joins with the forward declining bottom wall to form an air pocket for receiving a large portion of the air moving through the plenum chamber toward the controlling air chamber. The walls of the air pocket create a baffle which assists in controlling the force and velocity of air passing through the damper mechanism. The combination of the walls of the air pocket, and particularly the upright rear wall, and the variably controlled damper mechanism tend to spread out the air in the supply plenum before it discharges through the outlet of the control air chamber, and to minimize discharge jets of air of high velocity.

The bottom portion of the controlled air chamber which projects below the outlet passage of the plenum includes a plurality of transverse louvers pivotally mounted for angular adjustment in order to divert air discharging from the controlled air chamber at various angles over the cooking range.

In one modification of the make-up air device, all of the air discharged through the controlled air chamber descends vertically through the chamber and out through the louvers forming the bottom wall. A perforated plate may be mounted transversely of the air flow within the chamber between the inlet portion and the bottom louvers in order to act as a baffle to dampen the downward flow of air and reduce the velocity of the air.

In a second modification of the make-up air device, the adjustable louvers may be formed in a rear wall declining rearward toward a solid bottom wall having a single elongated discharge slot. Thus, the louvers provide a by-pass for most of the air, where light volume loads of air are handled by the exhaust hood.

In the third modification, the adjustable discharge louvers again may form the bottom wall of the controlled air chamber but no perforated plate is employed transversely of the air passage. The entire rear wall of the controlled chamber below the supply air plenum is perforated, and the major portion of this wall declines forward, again to provide a by-pass for air for handling light or medium volume loads of air.

All of the above make-up air devices may be utilized as original equipment in combination with the exhaust hood, or they may be incorporated in make-up modules which can be installed in conjunction with range exhaust hoods already in place.

Moreover, the controlled air chambers made in accordance with this invention, may be modular, and may be detachably secured within the outlet passage of the supply air plenum, so that the modular controlled air chamber may be readily removed for inspection, cleansing, maintenance, or replacement. Prior make-up air devices, including perforated plates, have been permanently installed, creating a build-up of dirt and grease on the perforated plates in inaccessible places for cleaning.

BRIEF DESCRIPTION OF THE DRAWINGS

FIG. 2 is a fragmentary top rear perspective view of a make-up air module having the same construction as the make-up air device of FIG. 1, but designed to be installed in combination with an existing exhaust hood, as illustrated in phantom in FIG. 1;

FIG. 4 is a fragmentary, top plan view, partly in section, of the damper mechanism disclosed in FIG. 3, in open position;

FIG. 4A is a fragmentary top plan view of an extension of the damper mechanism disclosed in FIG. 4, with the damper blades in a partially closed position;

FIG. 5 is a fragmentary section taken along the line 5—5 of FIG. 4, but partially broken away to disclose additional damper blades;

FIG. 6 is a fragmentary section taken along the line 6—6 of FIG. 4A;

FIG. 7 is an enlarged fragmentary section taken along the line 7—7 of FIG. 5;

FIG. 8 is a fragmentary end perspective view of a modified controlled air chamber, similar to the chamber disclosed in FIG. 3, with the end wall removed;

DESCRIPTION OF THE PREFERRED EMBODIMENTS

Figure 1:
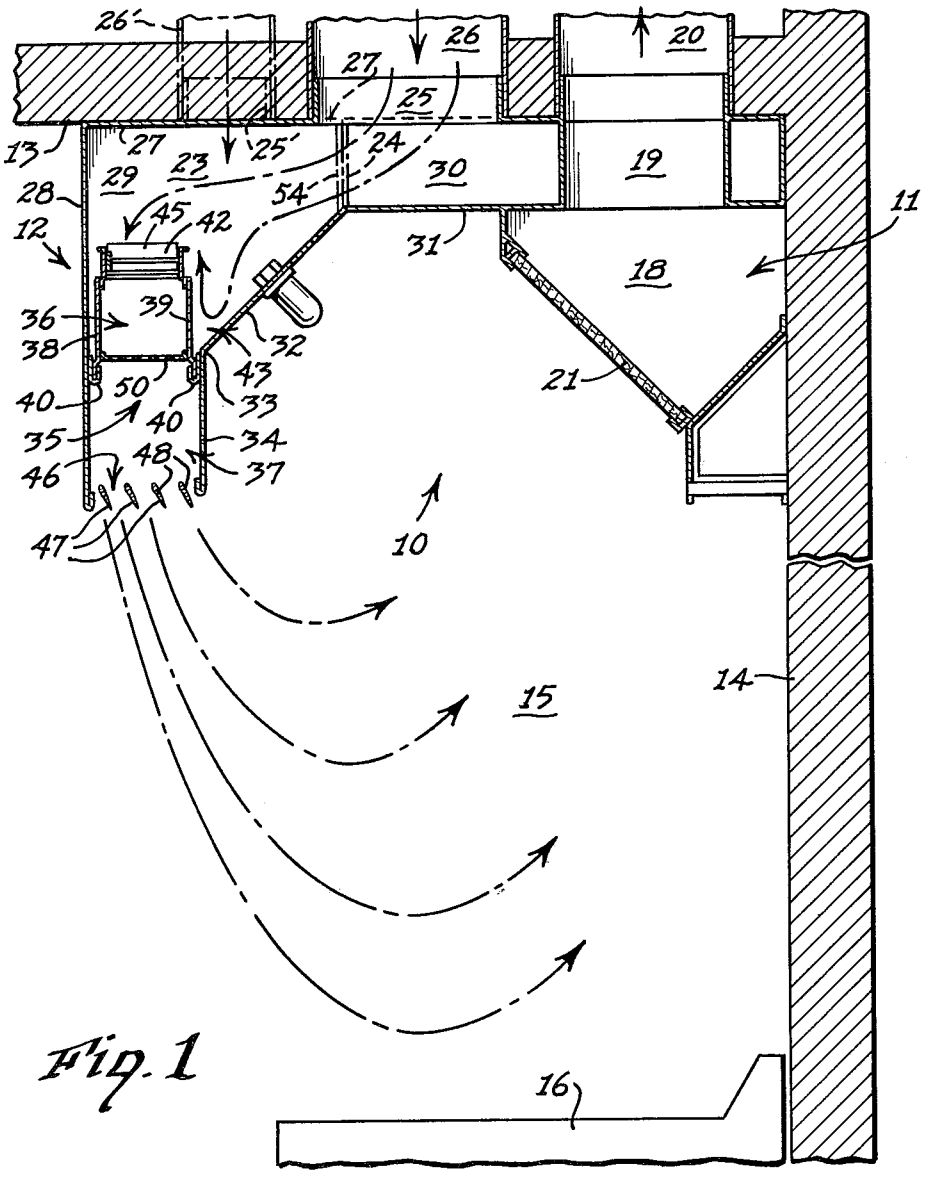
FIG. 1 is a sectional elevation illustrating a make-up air device, made in accordance with this invention, installed in combination with the exhaust hood of a complete overhead canopy mounted on the ceiling of a cooking area above a cooking range.

Referring now to the drawings in more detail, FIG. 1 discloses an overhead range canopy 10 including an exhaust hood 11 and a make-up air device 12, made in accordance with this invention, constructed as a unitary assembly. The canopy 10 is mounted against the ceiling 13 and one wall 14 of the cooking area or kitchen 15, and spaced over a cooking range 16.

The exhaust hood 11 includes an exhaust air plenum 18 having an outlet collar 19 connected to an exhaust duct 20 extending through a corresponding opening in the ceiling 13. An opening in the bottom of the plenum 18 is covered by an exhaust filter 21 in a conventional manner. Thus, air above the cooking range 16 entrained with smoke, grease, vapor and other particulates is drawn through the exhaust filter 21, the exhaust plenum 18, collar 19, and duct 20 by a conventional exhaust fan or blower, not shown, to discharge the exhaust air, gases and particulates outside of the cooking area 15.

The make-up air device 12 includes a supply air or make-up air plenum 23, separated from the exhaust plenum 18 by the circumferential wall of the collar 19. The supply air plenum 18 is provided with inlet collar 25 connected to the inlet duct 26 extending through a corresponding opening in the ceiling 13. A conventional make-up fan or supply air fan, not shown, mounted in an upper portion of the duct 26, not shown, draws outside air into the supply air plenum 23.

The supply air plenum 23 includes a top wall 27, a front wall 28 and end walls 29. The inlet extension portion 30 of the plenum 23 includes a bottom wall 31. Declining forwardly from the edge of the bottom wall 31 is a lower wall 32 which has a lower edge 33 joining a vertically depending lower chamber wall 34. The bottom edge 33 of the lower wall 32 is spaced from the front wall 28 to generally form an outlet passage 35.

Extending vertically through the outlet passage 36 is a controlled air chamber 36, the lower portion of which is defined by the lower portion of the front wall 28 and the depending rear wall 34.

The upper portion is defined by a front wall 38 and an upright rear wall 39 removably supported by flanges 40 in the outer passage 35 so that the upper inlet portion 42 of the chamber 36 is spaced substantially above the bottom edge 33 of the lower inclined wall 32 to form a V-shaped air pocket 43. This air pocket 43 is defined by the upright rear wall 39 of the upper portion of the controlled air chamber 36 and the forward declining lower wall 32 of the supply air plenum 23.

Mounted in the inlet portion 42 of the controlled air chamber 36 is a variably controlled damper mechanism 45 for adjusting the volume of air flow from the plenum 23 into the controlled air chamber 36.

In the discharge opening 46 between the bottom edges of the front wall 28 and the depending rear wall 34 is mounted a plurality of louvers or vanes 47 mounted on transverse pivot screws 48 for independent pivotal movement about parallel transverse pivotal axes. These vanes 47 may be independently pivotally adjusted in order to direct the flow of air through the discharge outlet 46, either vertically downward, or at various angular positions to cause the discharge air to flow downward and rearward over the range 16. The angular range of the discharge air flow from the vertical is almost 90°.

Mounted transversely within the controlled chamber 36 is a pressure plate 50 having a plurality of perforations 51. The perforated plate 50 is mounted between the damper mechanism 45 and the louvers 47 and extends transversely across the air flow in order to baffle, flatten out or dampen the downward flow of the air and to limit the velocity of the discharged air.

Figure 3:
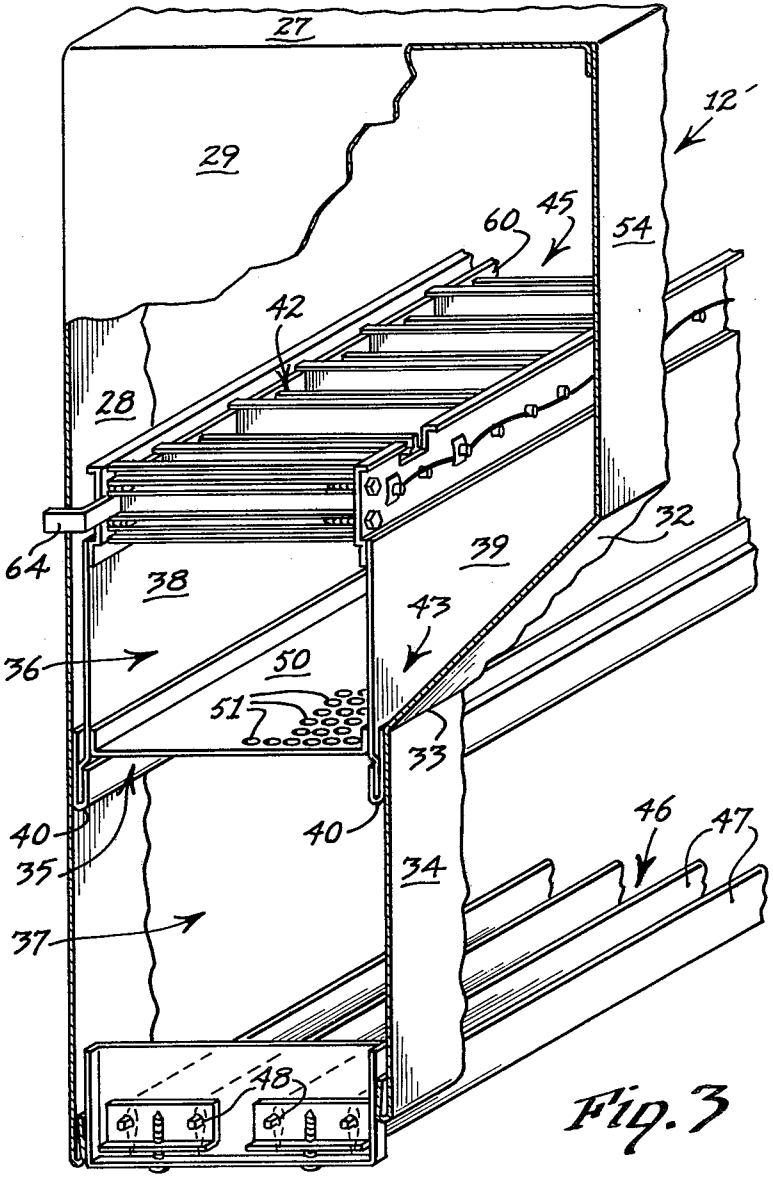
FIG. 3 is an enlarged, fragmentary, perspective end view of the module disclosed in FIG. 2, with a portion of the end wall broken away along the line 3—3 of FIG. 2.

Instead of forming the original equipment in the canopy 10, the make-up air device 12 may be modified to form a module 12' (FIGS. 2 and 3), having the same corresponding elements of the make-up device 12, except that the module 12' has a separate rear wall 54 connecting the top wall 27 and the top edge of the forward declining lower wall 32, as illustrated in FIGS. 2 and 3, and by dashed lines in FIG. 1. Moreover, the module 12' has its own inlet collar 25' in a different location from collar 25.

As illustrated in FIG. 1, the collar 25' is inserted through a different opening in the ceiling 13 and connected to supply air duct 26'. The rear wall 54 of the module 12' would be fitted against the front wall 24, illustrated in dashed lines in FIG. 1, of an existing exhaust system. Moreover, the collar 25 and duct 26 would be eliminated, and the corresponding supply opening would be covered by the top wall 27 of the make-up air device 12' and the top wall of the exhaust hood 11.

In certain installations, the collar 25' and its accompanying air supply inlet opening could be formed in the front wall as indicated in phantom lines 25'' in FIG. 2, if desired.

The damper mechanism 45 is shown in more detail in FIGS. 3–7. The damper mechanism 45 includes a plurality of parallel vanes or dampers 55 having pivot rods or trunions 56 projecting coaxially from the opposite mid-portions of the edges of each damper blade 55 and supported for pivotal movement in the horizontal portions 57 of the L-shaped slots, which also have vertical portions 58 and 59, and a longitudinal actuator bar 60. Outside of the actuator bar 60 are the parallel damper support frame members 61 into which the ends of the pivot rods 56 are journaled.

Also projecting laterally from the opposite edges of the damper blades 55 are connector lugs 62 for engagement with the respective upper and lower vertical slots 58 and 59. As illustrated in FIGS. 5 and 6, the lugs 62 and vertical slots 58 and 59 alternate on consecutive blades 55 between positions either above or below the pivotal axes of the pivot rods 56.

The actuator bar 60 may be connected to any convenient handle 64 or other manual means for longitudinally moving the actuator bar 60 between positions, such as those disclosed in FIGS. 5 and 6. Levers or other extensions may be connected to the handle 64 or actuator bar 60 to reciprocably move the actuator bar 60 longitudinally, if desired.

With the actuator bar 60 in the position disclosed in FIG. 5, the vanes 55 are substantially vertical and parallel, with the lugs 62 in substantially vertical alignment with the pivot rods 56. When the actuator bar 60 is moved toward the left of FIG. 6, in the direction of the arrow, the vertical slot portions 58 and 59 move the lugs 62 laterally in the same direction to cause the vanes or blades 55 to pivot alternately in opposite directions, so that every even blade 55 pivots in the same direction, and every odd blade pivots in the opposite direction. Accordingly, adjacent blades 55 pivot toward each other toward a closed position.

The actuator bar 60 is substantially infinitely variable, so that the openings between the blades 55 may be infinitely varied between a fully open position, such as that disclosed in FIG. 4, and a fully closed position, not shown. Therefore, the volume of air moving from the plenum 23 through the inlet portion 42 may be very accurately controlled.

In either of the make-up devices 12 or 12', the upper control chamber 36, by virtue of its detachable connection in the flanges 40, may be removed from their respective devices 12 or 12' for inspection, cleansing, maintenance, or replacement. The vanes 47 may also be removed by unfastening the pivot screws 48, for cleansing or replacement, and also to permit removal of the upper control chamber 36.

FIG. 8 discloses the lower portion of a modified controlled air chamber 67 in which the front and rear walls 38 and 39 are extended downward to the bottom of the chamber 67 to form lower walls 68 and 69. Thus, the lower chamber 67 is provided with double front walls 28 and 68, and double rear walls 34 and 69, to provide deep air pockets on both sides of the lower chamber 67 for dampening some of the supply air.

Preferably, the wall 34 is perforated with apertures 70 in any desired number, shape or configuration to permit the lateral rearward discharge of some of the supply air at a dampened low velocity. For some applications, the apertures 70 may be eliminated.

The entire lower control chamber 67 including the inner walls 68 and 69, as well as the upper control chamber including the walls 38 and 39, may be slipped downward, and removed from the air discharge outlet for inspection, cleansing, maintenance and replacement. The lower flanges of the respective walls 68-28, and 69-34 may be secured by detachable fasteners, not shown. The vanes 47 may, of course, also be removed by unthreading the screws 48, as previously described.

Figure 9:
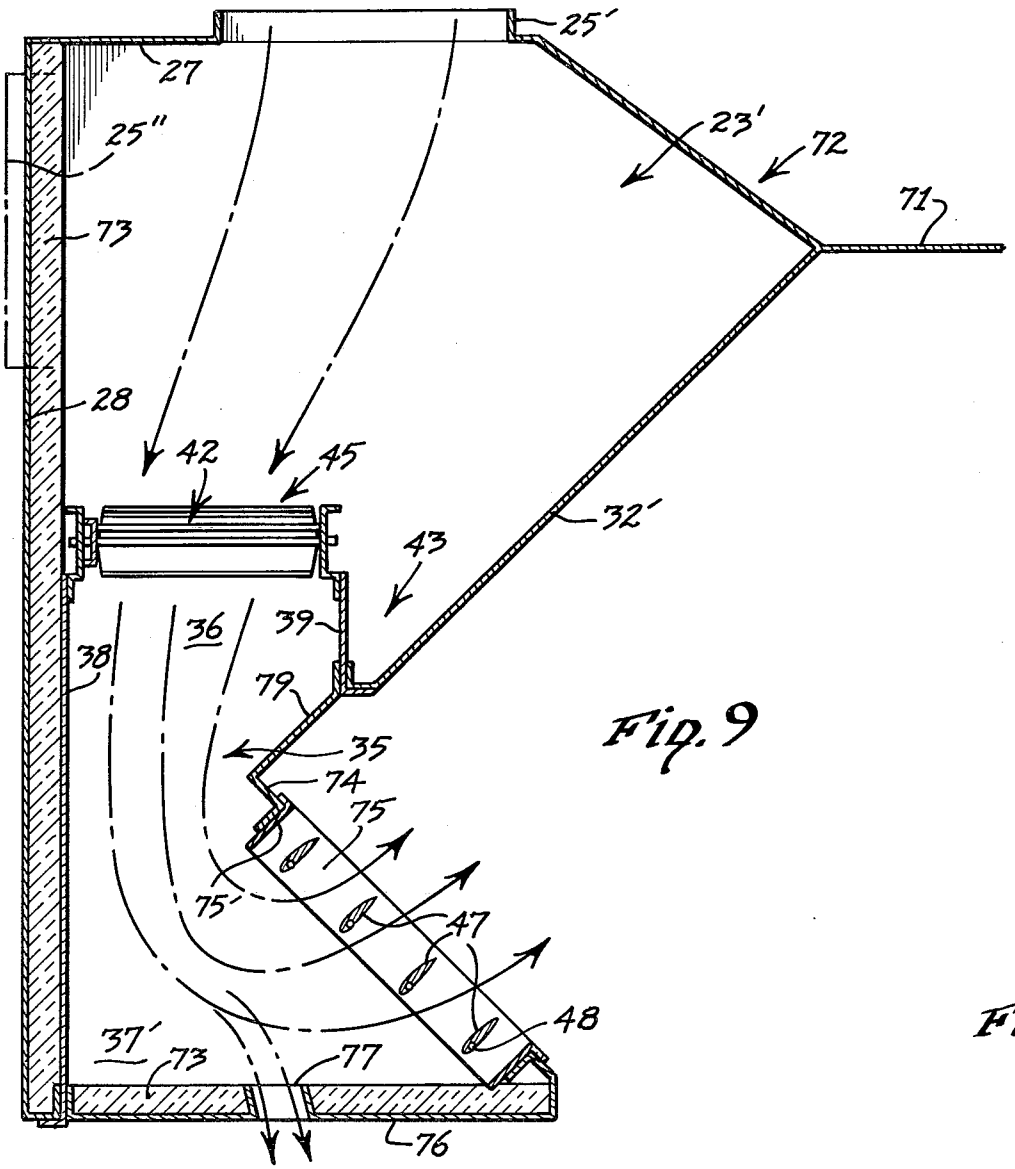
FIG. 9 is an enlarged, fragmentary elevation of a second modified make-up section air device.

The make-up air device 72 disclosed in FIG. 9 differs from make-up air device 12 in the shape of the walls of the supply air plenum 23', the optional insulation strips 73, and the construction of the lower chamber portion 37'. The parts of the device 72 which are the same as the device 12 have the same reference numerals as corresponding parts of the device 12.

The upper portion of the controlled air chamber 36 has the same inlet 42 and damper mechanism 45 as in the devices 12 and 12'.

However, the inclined lower wall 32' of the supply air plenum 23' joins a web 71 connected to the exhaust air plenum, not shown. A declining rear wall section 79 joins at approximately a 90° angle a rearward declining lower chamber wall 74 having a discharge opening 75. A discharge frame 75' is removably fitted within the discharge opening 75. The parallel louvers 47 are pivotally mounted upon the pivot screws 48 within the frame 75'. The bottom edge of the rear chamber wall 74 joins the rear edge of a horizontal bottom chamber wall 76, the front edge of which merges with the bottom of the front wall 28, thereby completing the enclosure of the lower controlled air chamber 37'.

Formed in the bottom wall 76 is an elongated narrow discharge slot 77 extending transversely of the module 72. Accordingly, air moving through the inlet portion 42 of the chamber 36 passes downwardly to the bottom chamber portion 37', where most of the air is deflected off the bottom wall 76 and upward at approximately 45° through the discharge opening 75. The direction of discharge through the opening 75 can of course be controlled by manipulating the louvers 47 to direct the air in a more horizontal or a more vertical direction or anywhere in between. The discharge slot 77 permits a limited volume of the air to continue downward to form an air curtain above the front portion of the range 16, in order to minimize the amount of make-up air from the rest of the kitchen area, and also to prevent the discharge of foul air from the area immediately above the range 16 back into the kitchen area.

The discharge frame 75', including the louvers 47, may be removed for cleaning and maintenance. Moreover, the upper and lower chamber portions 36 and 37', may be removed from the supply air plenum 23' by separation of the wall 79 from the wall 39 and by separation of the bottom wall 76 from the front wall 38 by removal of detachable fasteners, not shown, so that the interior of the chambers 36 and 37' and the damper mechanism 45 may be cleaned.

The insulation strips 73 may be used to line the front wall 28 and the bottom wall 76, as shown in FIG. 9, and may also be used to line the ends walls, in order to prevent condensation.

The make-up air device 72 is particularly adapted for cooking areas in which the cooking load is relatively light and lesser amounts of foul cooking air need to be exhausted. Thus, only the air discharged through the discharge slot 77 would have much effect upon the comfort of the cook.

Figure 10:
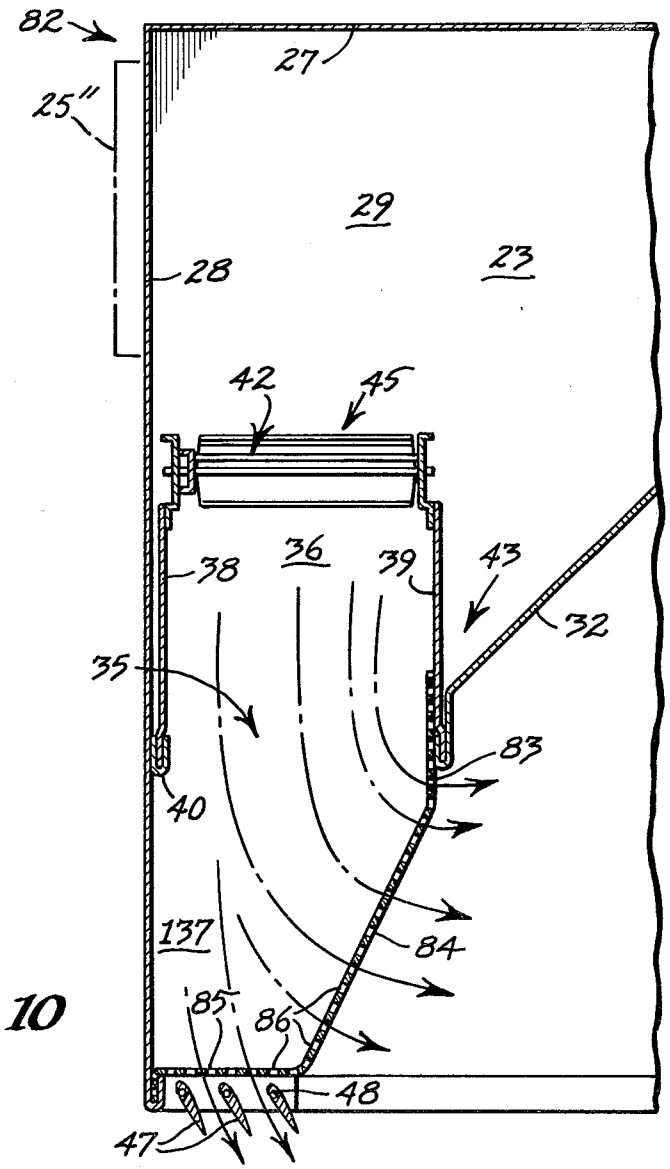
FIG. 10 is an enlarged, fragmentary sectional elevation of a third modified make-up air device.

The third embodiment of a make-up air device 82 is disclosed in FIG. 10, which has its upper portion similarly constructed to the device 12. Accordingly, similar parts have the same reference numerals.

Here again, the major modification is in the walls of the lower portion of the controlled air chamber 137, which includes a perforated rear wall having a vertical portion 83, a major forward declining portion 84 and a horizontal perforated bottom wall portion 85.

Mounted below the perforated bottom wall 85 are the independently controlled louvers 47 journaled about the pivot screws 48 for directing the flow of the air through the apertures 86 in bottom wall 85 substantially vertically or gradually rearwardly. The perforated angular plate 84 permits the majority of the air to pass through at damped velocities primarily rearwardly, but sufficiently downwardly to pick up the exhaust gases in the area above the cooking range 16.

The upper air control chamber 36 may be removed from the plenum 23, in the device 82, in the same manner as it is removed from the device 12 as previously described. Moreover, the perforated wall portions 83, 84 and 85 may be removed by unfastening detachable fasteners connecting the upper wall portion 83 to the wall portion 39 and the wall portion 85 to the bottom edge portion of the front wall 28. Thus, the upper air control chamber 36, the damper mechanism 45 and the perforated wall portions 83, 84 and 85, are separable for cleansing and maintenance.

The make-up air device 82 is useful for both light and medium cooking loads, permitting more air to descend in a front air curtain than the device 72, but not as much as in the device 12 or 12'.

In the preferred form of the embodiments of the modules 72 and 82, no transverse perforated plate is incorporated in the chamber 36 because, in the device 72, the air is baffled by the bottom wall 76 before discharging through the upwardly directed discharge opening 75, while in the module 82, the perforated plate 50 is replaced by the perforated wall portions 83, 84 and 85.

It is therefore apparent that a make-up air device, whether in the form of the devices 12, 12', 72 or 82, has been designed which provides for careful control of not only the volume of air discharging from the plenum 23 over the cooking range, but also controls such volume through the damper mechanism 45 with a great degree of accuracy. Furthermore, the volume of air is also controlled by the arrangement of the inlet portion 42 of the controlled air chamber 36 being elevated above the forwardly declining wall 32 to provide the air pocket 43 to assist in baffling, breaking up, spreading out, and circulating some of the air within the plenum 23, before it passes through the inlet portion 42. Such construction would not only permit better control of the air volume, but also reduces the velocity of the air moving through inlet portion 42, and tends to establish a more nearly uniform static pressure in the plenums 23 and 23'.

The diverter vanes or louvers 47 are independently pivotally mounted in the lower portions 37, 67, 37' and 137 of the respective devices to more accurately control the direction of the air discharged from the make-up air devices 12, 12', 72 and 82, and permit the discharged air to be directed rearwardly over the range 16 in only sufficient amounts for handling the load of the exhaust vapors and smoke from the cooking operation and urging such smoke, vapors and four air into the exhaust stream.

The diverter vanes or louvers 47 also function to produce a downward directed air curtain in order to isolate the air over the range from the outside kitchen area, thereby preventing foul air above the range from discharging into the kitchen area, and conditioned air from the kitchen area from flowing over the range and into the exhaust hood.

The perforated transverse plate 50 and the perforated walls 83-85 are provided in their respective modules 12, 12' and 82 in order to flatten out, dampen and thereby reduce the velocity of the discharged air stream to minimize the drafts in the cooking area 15.

Since only minimal amounts of air are discharged from the device 72 through the discharge slot 77, which is also angled rearwardly, and most of the air discharged from the chamber 37' is directed upwardly through the discharge opening 75, then the perforated plate 50 is not necessary for the controlled air chamber 36 and 37'.

By utilizing the above various combinations of air control elements, the supply air is better controlled to minimize drafts upon the kitchen personnel and to minimize disturbing the conditioned air equilibrium within the kitchen, thereby conserving energy.

What is claimed is:

1. A make-up air device for use in combination with an overhead exhaust hood above a cooking range, comprising:

(a) a supply air plenum adapted to be mounted above the front portion of a cooking range, (b) said plenum having a lower portion, including a front wall, (c) a supply air inlet communicating with the interior of said supply air plenum, (d) said lower portion comprising a lower wall terminating in a lower edge portion spaced from said front wall to define an air outlet passage, (e) a controlled air chamber extending vertically through said outlet passage, (f) said controlled air chamber comprising an upright rear wall projecting above said lower edge portion of said lower wall to form an air pocket in the lower portion of said plenum behind said upright rear wall, (g) said controlled air chamber comprising an inlet portion above said lower edge portion of said lower wall, and communicating with said plenum, whereby air within said supply air plenum is spread out by said air pocket before the air discharges through said inlet portion, (h) damper means having variable size openings in said inlet portion, (i) means for controlling said damper means to vary the size of said openings in order to vary the volume of air flowing through said inlet portion into said controlled air chamber, (j) said controlled air chamber having a discharge opening through which air from said chamber is discharged above the cooking range, (k) variably movable louvers mounted in said discharge opening for directing and changing the flow of air through said discharge opening, and (l) baffle means within said controlled air chamber for flattening out and dampening the flow of air from said damper means to said discharge opening to reduce the velocity of the air flow through said discharge opening.

2. The invention according to claim 1 in which said baffle means comprises a perforated plate mounted in said controlled air chamber transversely of the flow path through said controlled air chamber and between said inlet portion and said discharge opening.

3. The invention according to claim 1 in which said baffle means comprises a wall in said controlled air chamber below said damper means for intercepting and baffling the flow of air from said damper means and deflecting said air through said discharge opening at a substantially reduced velocity.

4. The invention according to claim 1 in which said damper means comprises a plurality of pivotally mounted damper blades spaced to form said variable size openings and movable between open and closed positions to vary the size of said openings, said means for controlling said damper means comprising actuator means operatively connected to said damper blades.

5. The invention according to claim 1 in which said louvers in said discharge opening comprise a plurality of louvers journaled about parallel pivotal axes, transversely of the air flow through said discharge openings, for pivotal movement to direct the discharge of air at different angles over the cooking range.

6. The invention according to claim 1 in which said lower chamber portion comprises a perforated lower rear wall adjacent said discharge opening.

7. The invention according to claim 1 in which said controlled air chamber is removable from said air outlet passage, and means detachably securing said controlled air chamber within said outlet passage.

* * * * *